US007503446B2

(12) United States Patent
Yoshioka

(10) Patent No.: US 7,503,446 B2
(45) Date of Patent: Mar. 17, 2009

(54) BILL HANDLING DEVICE

(75) Inventor: Kazuei Yoshioka, Koto-ku (JP)

(73) Assignees: ARUZE Corp., Tokyo (JP); Seta Corp., Tokyo (JP)

( * ) Notice: Subject to any disclaimer, the term of this patent is extended or adjusted under 35 U.S.C. 154(b) by 54 days.

(21) Appl. No.: 11/423,300

(22) Filed: Jun. 9, 2006

(65) Prior Publication Data

US 2007/0000752 A1 Jan. 4, 2007

(30) Foreign Application Priority Data

Jun. 17, 2005 (JP) ..... 2005-178269

(51) Int. Cl.
*G07D 11/00* (2006.01)
*G07D 13/00* (2006.01)

(52) U.S. Cl. ..... 194/351; 194/203; 235/1 A

(58) Field of Classification Search ..... 194/351, 194/350, 203; 235/1 A, 24; 463/44, 45, 463/46; 902/17; 292/DIG. 17, DIG. 39, 292/DIG. 40, 341.16, 341.17, 156; 312/215, 312/216, 220
See application file for complete search history.

(56) References Cited

U.S. PATENT DOCUMENTS 4,569,294 A * 2/1986 Beattie et al. ..... 109/45
5,887,695 A 3/1999 Hatamachi et al.
6,067,530 A * 5/2000 Brooks et al. ..... 705/30
6,105,747 A * 8/2000 Uemizo et al. ..... 194/203
6,676,175 B2 * 1/2004 Jaeb et al. ..... 292/116
7,252,287 B2 * 8/2007 Tsutoh ..... 271/274

FOREIGN PATENT DOCUMENTS

JP 2004-318481 11/2004
WO WO 98/03945 1/1998

* cited by examiner

*Primary Examiner*—Patrick Mackey
*Assistant Examiner*—Mark Beauchaine
(74) *Attorney, Agent, or Firm*—Oblon, Spivak, McClelland, Maier & Neustadt, P.C.

(57) ABSTRACT

There is provided a highly secure bill handling device that can essentially prevent bill removal. The bill handling device according to the invention includes a bill container for storing a bill inserted through a bill insertion slot, an exit through which the bill container projects out of a housing, an openable/closable shutter for closing the exit, a shutter drive module for opening and closing the shutter, a lock member movably supported between a locked position where the shutter is not allowed to open and an unlocked position where the shutter is allowed to open, and a lock member moving module for moving the lock member between the locked position and the unlocked position.

7 Claims, 16 Drawing Sheets

BILL HANDLING DEVICE

RELATED APPLICATION

This application claims the priority of Japanese Patent Application No. 2005-178269 filed on Jun. 17, 2005, which is incorporated herein by reference.

BACKGROUND OF THE INVENTION

1. Field of the Invention

The present invention relates to a bill handling device that is installed in an amusement arcade where Pachinko gaming machines, slot machines and the like (hereinafter referred to as "game machine") are installed and that can be disposed in between game machines.

2. Description of the Related Art

An amusement arcade such as a Pachinko parlor generally has an area (also referred to as "bank") where a large number of game machines are installed, and for players convenience, in between adjacent game machines is installed a vertically long game medium dispensing device (also referred to as "sandwich device") for dispensing pachinko balls or coins (game mediums). The game medium dispensing device is mounted on a frame fixed in between the game machines. When the game medium dispensing device receives a bill, coin, prepaid card or the like through a corresponding insertion slot, the device itself dispenses game mediums or sends the game machine a signal prompting it to dispense game mediums. For example, the game medium dispensing device may be a bill handling device capable of handling bills that includes a bill discriminator for discriminating an inserted bill and a bill container (repository) for storing bills validated in the bill discriminator.

In the above described bill handling device that handles cash, various safety measures are taken to prevent a malicious individual from removing bills themselves or the bill container for storing bills. For example, Japanese Unexamined Patent Publication No. 2004-318481 discloses an anti-removal mechanism for preventing a unit with a bill insertion slot from being removed from a frame body that acts as an exterior member and therefore providing improved security.

However, preventing the actual removal of the unit with a bill insertion slot from the frame body may not be enough, because bills themselves may be removed from the unit in a malicious manner. For example, when the anti-removal mechanism is defeated and the unit is not protected from being removed through the front opening of the frame body, the bills are conceivably removed directly from the unit through the front opening in some way. It is desired to enhance security as malicious acts have become increasingly sophisticated in recent years.

SUMMARY OF THE INVENTION

The invention has been made in view of the above situations and aims to provide a highly secure bill handling device that can essentially prevent bill removal.

To solve the above problems, the bill handling device according to a first aspect of the invention comprises a housing; a bill insertion slot provided on the front side of the housing, through which a bill can be inserted; a bill container for storing the bill inserted through the bill insertion slot; an exit through which the bill container projects out of the housing; an openable/closable shutter for closing the exit; a shutter drive module for opening and closing the shutter; a lock member movably supported on the housing between a locked position where the shutter is not allowed to open and an unlocked position where the shutter is allowed to open; and a lock member moving module for moving the lock member between the locked position and the unlocked position.

In the bill handling device according to the first aspect, since there are provided the exit through which the bill container projects out of the housing, the openable/closable shutter for closing the exit, and the lock member movable between the locked position where the shutter is not allowed to open and the unlocked position where the shutter is allowed to open, positioning the lock member in the locked position to prevent the shutter from opening can not only prevent the bill container from being removed through the exit, but also prevent the bills from being removed directly from the bill container through the exit. That is, the above arrangement essentially prevents bill removal, providing a highly secure bill handling device.

BRIEF DESCRIPTION OF THE SEVERAL VIEWS OF THE INVENTION OF THE DRAWINGS

The accompanying drawings, which are incorporated in and constitute a part of the specification, illustrate embodiments of the invention, and together with the general description given above and the detailed description of the embodiments given below, serve to explain the principals of the invention.

Figure 9A:
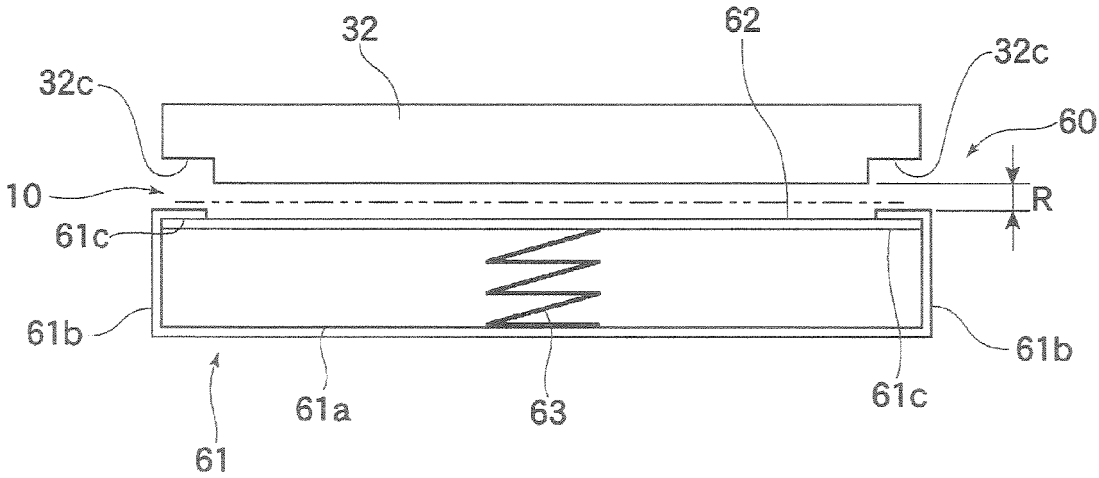
Figure 9B:
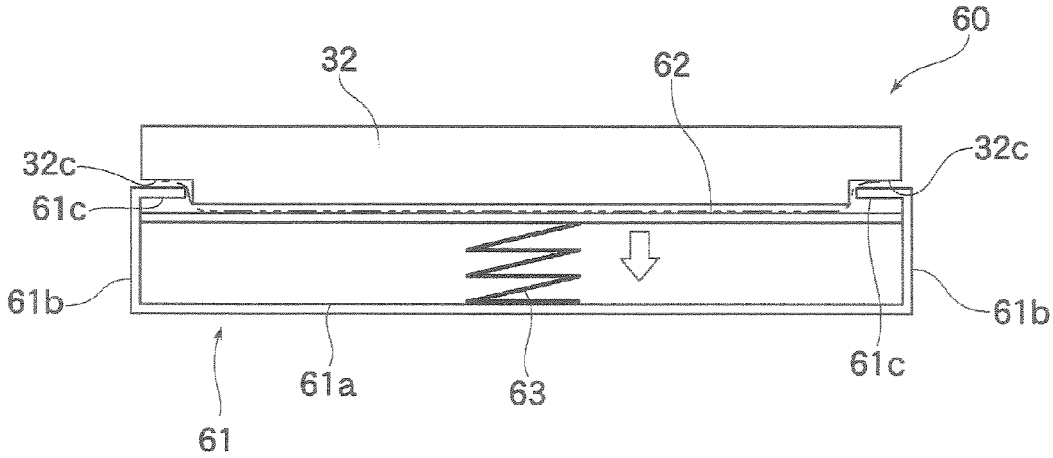
Figure 9C:
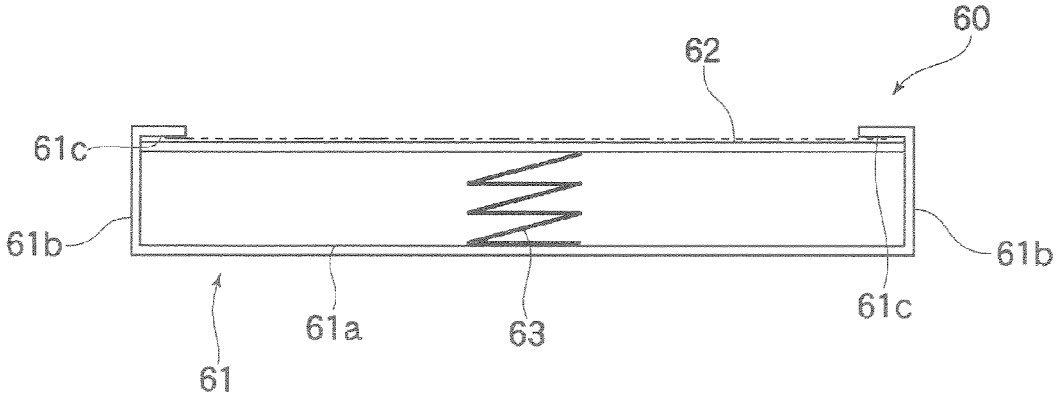
Figure 10:
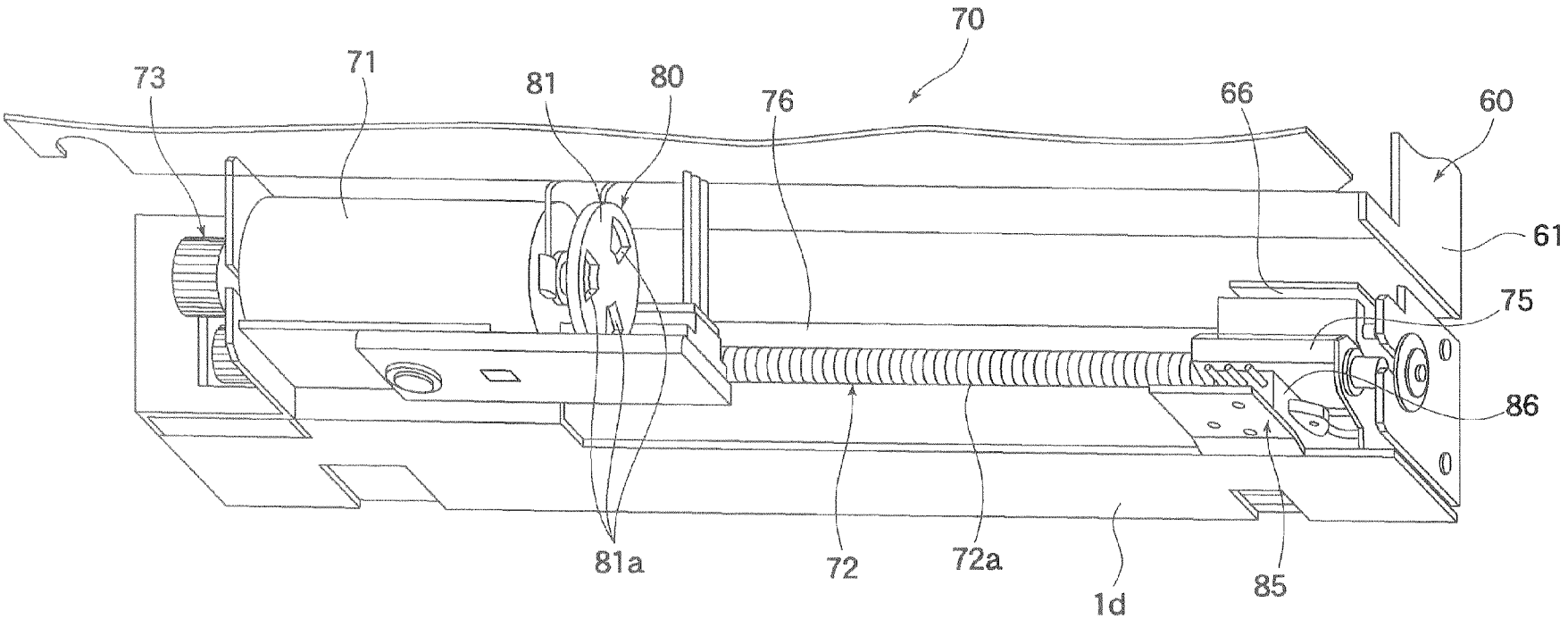
Figure 11:
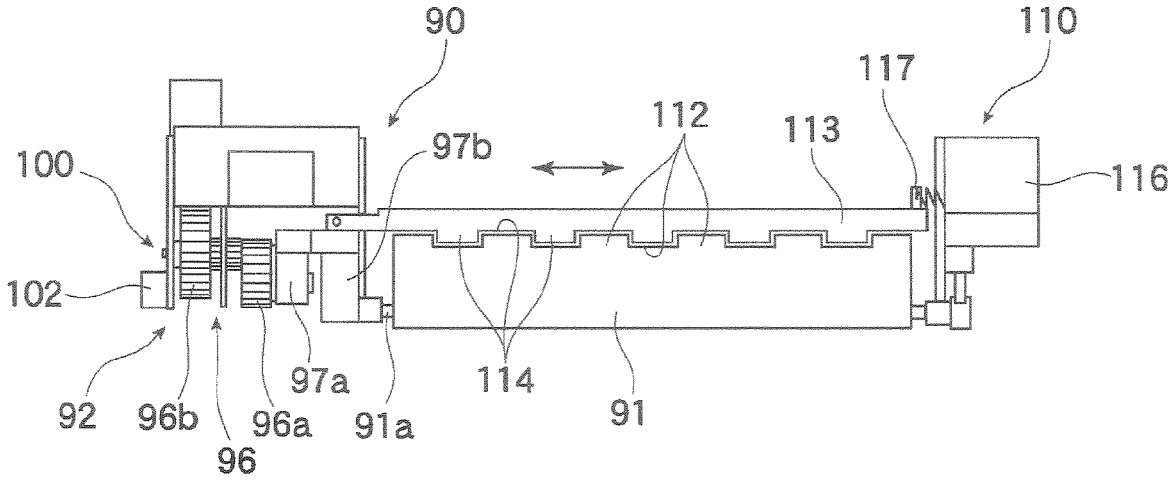
Figure 12:
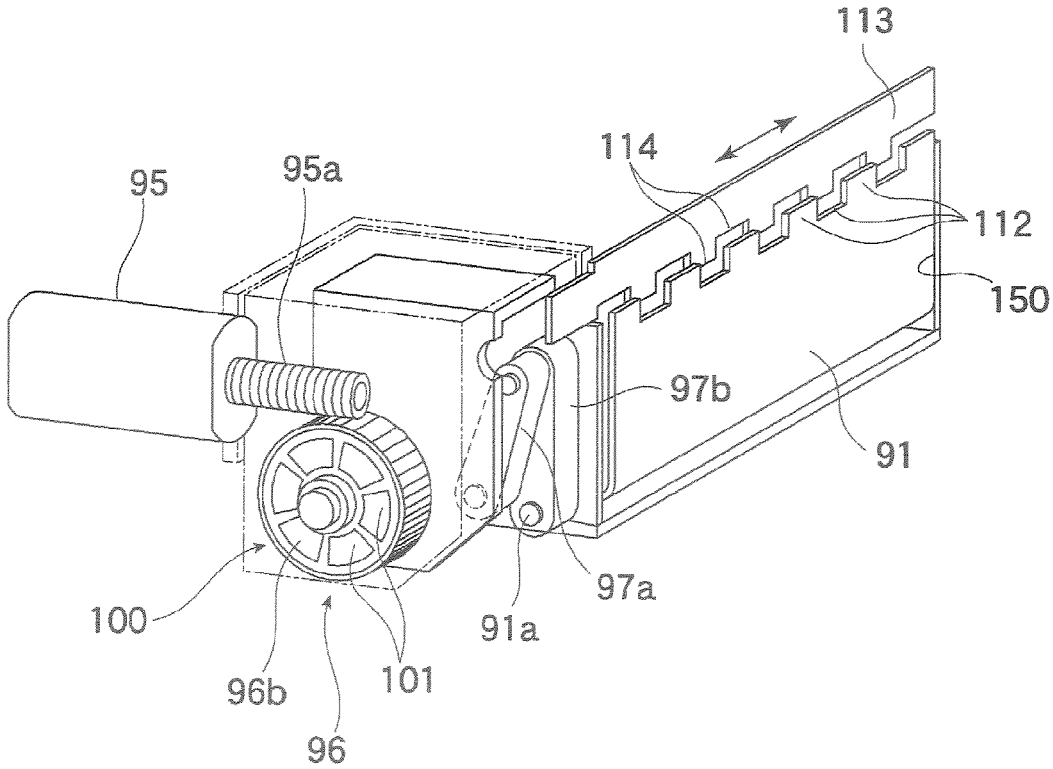
Figure 13A:
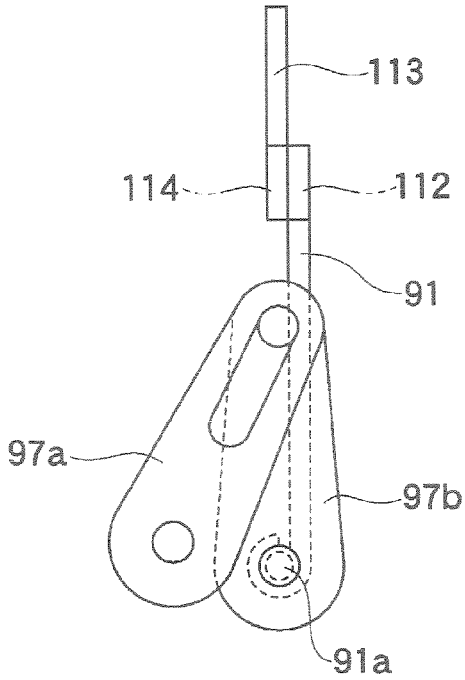
Figure 13B:
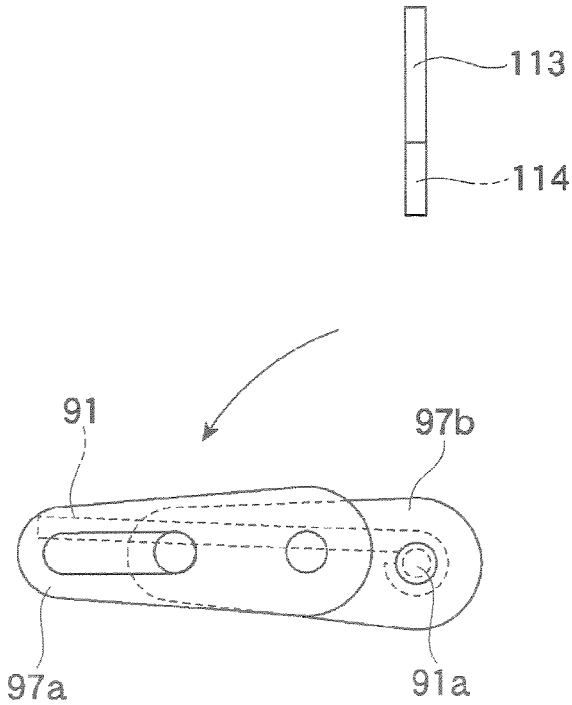
Figure 14:
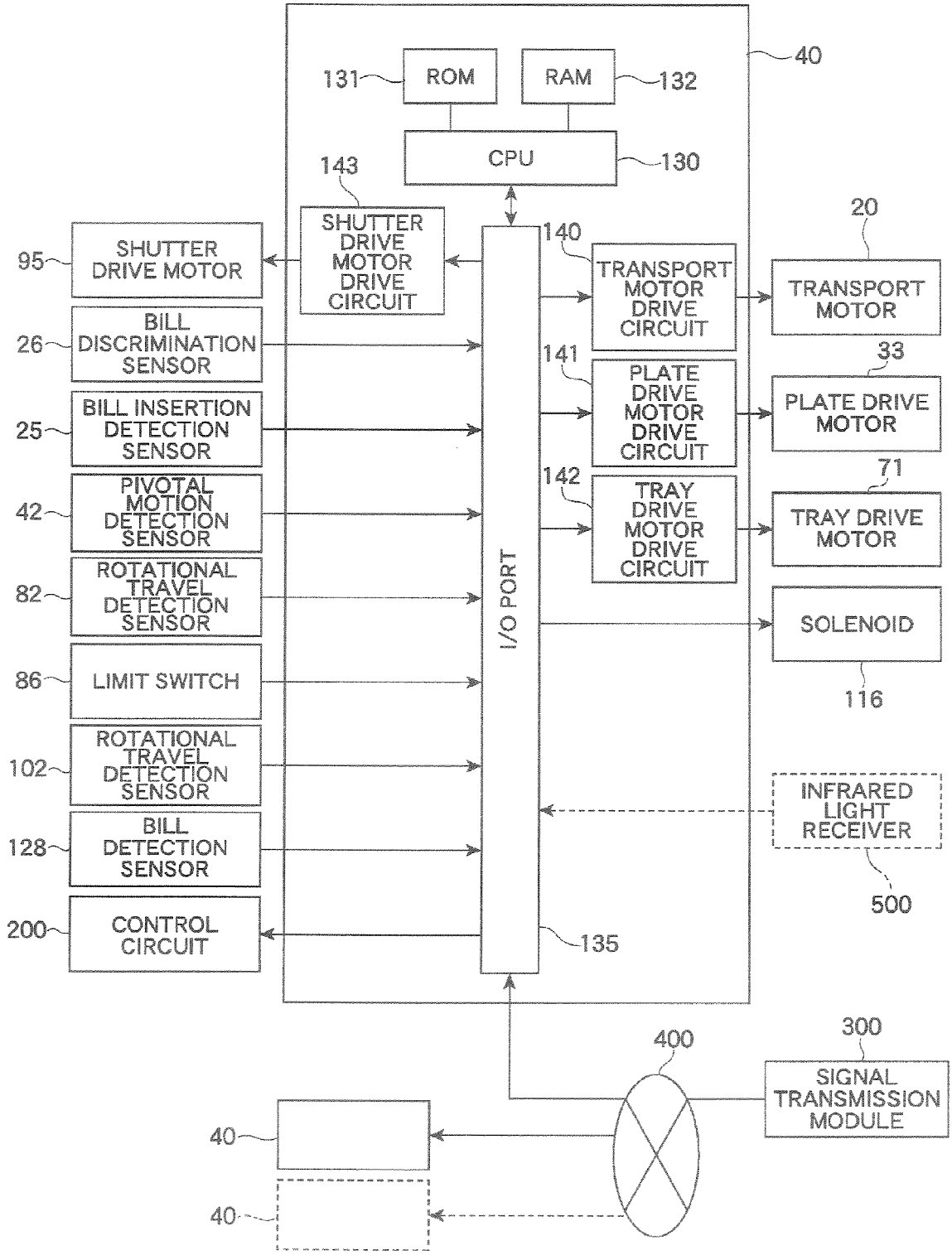
Figure 15:
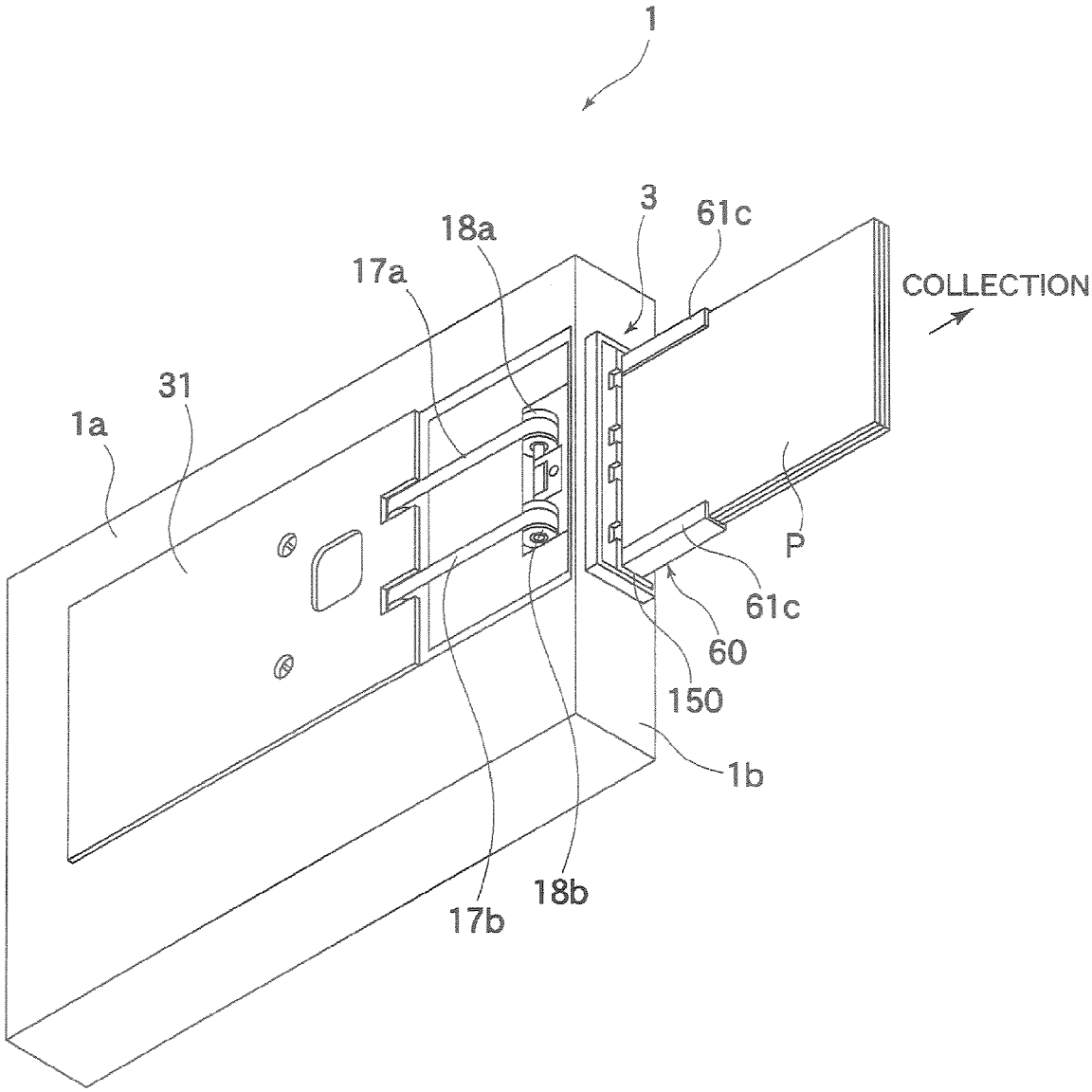

FIG. 9A explains how the press plate presses the bill into the stacking tray and shows the state before the bill is pressed;

FIG. 9B explains how the press plate presses the bill into the stacking tray and shows the state when the bill is being pressed;

FIG. 9C explains how the press plate presses the bill into the stacking tray and shows the state after the bill is pressed;

FIG. 10 shows the arrangement of the stacking tray drive mechanism;

FIG. 11 is a front view showing the arrangement of the shutter mechanism and the locking mechanism;

FIG. 12 is a perspective view showing the arrangement of the shutter drive mechanism;

FIG. 13A is a side view of the shutter mechanism when it is locked;

FIG. 13B is a side view of the shutter mechanism when it is unlocked;

FIG. 14 is a block diagram showing an exemplary arrangement of the controller for controlling the operation of the bill handling device; and FIG. 15 shows the stacking tray when it is ejected. an openable/closable shutter 91

DESCRIPTION OF THE PREFERRED EMBODIMENTS

According to a first aspect of the invention there is provided a bill handling device (e.g., a bill handling device 1) of this embodiment comprising: a housing (e.g., a housing 1*a*); a bill insertion slot (e.g., a bill insertion slot 3A) provided on the front side of the housing, through which a bill can be inserted; a bill container (e.g., a stacking tray 60) for storing the bill inserted through the bill insertion slot; an exit (e.g., an exit 150) through which the bill container projects out of the housing; an openable/closable shutter (e.g., an openable/closable shutter 91) for closing the exit; a shutter drive module for opening and closing the shutter; a lock member movably supported on the housing between a locked position where the shutter is not allowed to open and an unlocked position where the shutter is allowed to open; and a lock member moving module for moving the lock member between the locked position and the unlocked position.

In the bill handling device according to the first aspect, since there are provided the exit through which the bill container projects out of the housing, the openable/closable shutter for closing the exit, and the lock member movable between the locked position where the shutter is not allowed to open and the unlocked position where the shutter is allowed to open, positioning the lock member in the locked position to prevent the shutter from opening can not only prevent the bill container from being removed through the exit, but also prevent the bills from being removed directly from the bill container through the exit. That is, the above arrangement essentially prevents bill removal, providing a highly secure bill handling device.

According to a second aspect, the bill handling device according to the first aspect further comprises a biasing module that always biases the lock member to the locked position.

The bill handling device according to the second aspect not only provides the same advantage as the bill handling device according to the first aspect, but also includes the biasing module to hold the lock member in the locked position, more securely protecting the bills from being removed.

According to a third aspect, the bill handling device according to the first or second aspect is configured such that the lock member (e.g., the lock plate 113) has an opposite portion adjacent to and facing the shutter, on which portion are formed recesses and projections along the moving direction of the lock member, while projections and recesses that can engage the recesses and projections are formed on a portion of the shutter that faces the opposite portion of the lock member. In the locked position, the recesses and projections of the lock member and the projections and recesses of the shutter are held such that they do not engage with each other, preventing the shutter from opening. In the unlocked position, the recesses and projections of the lock member and the projections and recesses of the shutter engage with each other, allowing the shutter to be opened.

The bill handling device according to the third aspect not only provides the same advantage as the bill handling device according to the first or second aspect, but also performs the locking and unlocking through the engagement and disengagement between the recesses and projections of the lock member and the projections and recesses of the shutter, allowing the lock mechanism to be actuated with less travel of the lock member in an efficient and effective manner and the size of the device to be ultimately reduced.

According to a fourth aspect, the bill handling device according to any one of the first to third aspects is configured such that the pivotal motion of the shutter into the housing opens the exit.

The bill handling device according to the fourth aspect not only provides the same advantage as the bill handling device according to any of the first to third aspects, but also pivots the shutter into the housing to open the exit though which only the bill container projects outside, allowing bill collection from the bill container without interference with the shutter and the bill collection to be carried out in a quick and efficient manner. Furthermore, cutouts are preferably provided on the bill container along its projection direction to avoid its interference with the shutter such that the pivotal motion of the shutter into the housing will not interfere with the projecting motion of the bill container.

According to the invention, there is provided a highly secure bill handling device that can essentially prevent bill removal.

Additional objects and advantage of the invention will be set forth in the description which follows, and in part will be obvious from the description, or may be learned by practice of the invention. The objects and advantages of the invention may be realized and obtained by means of the instrumentalities and combinations particularly pointed out hereinafter.

An embodiment of the invention will be described below with reference to the drawings.

Figure 1:
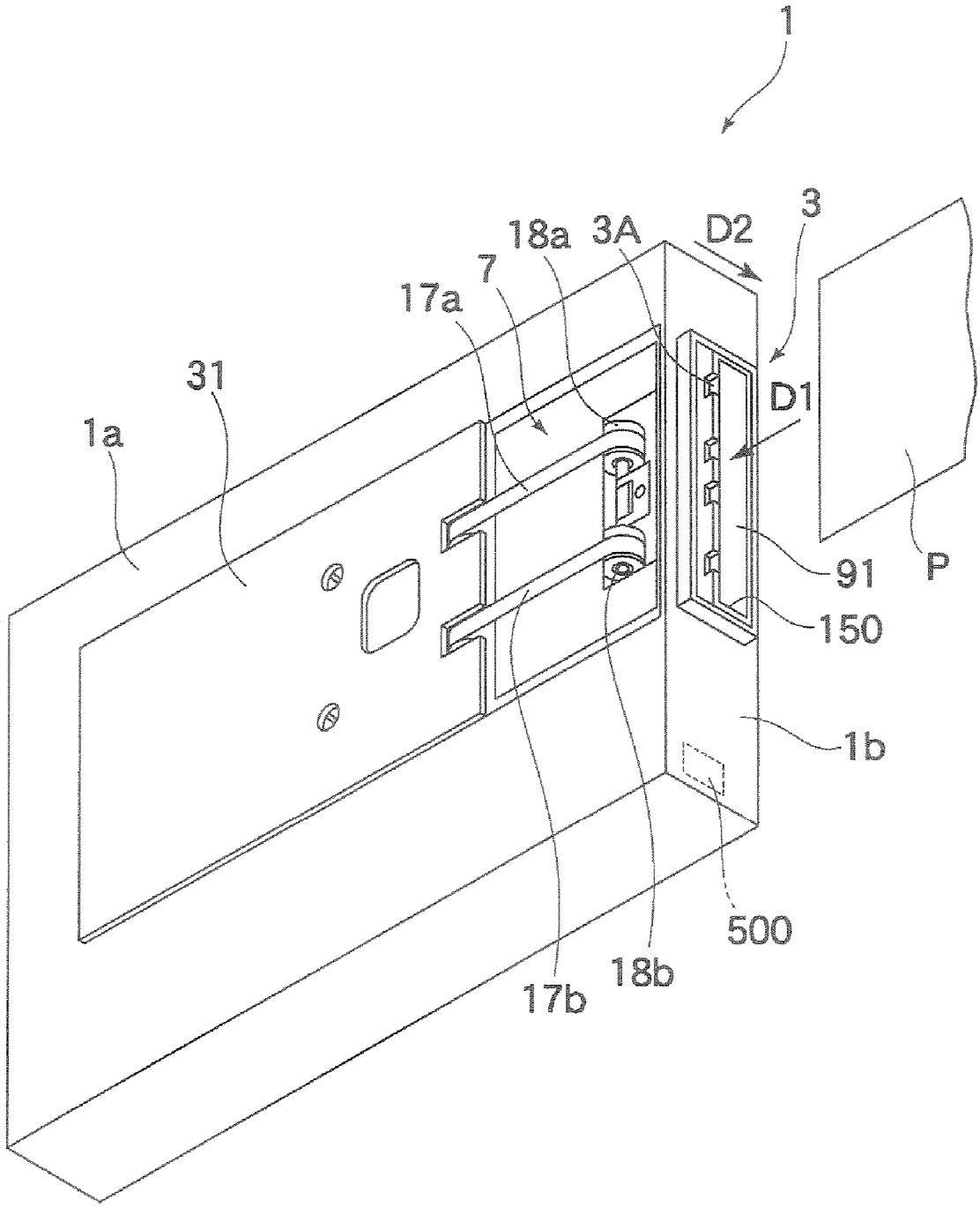
FIG. 1 is a perspective view showing the overall arrangement of the bill handling device according to the invention.
Figure 2:
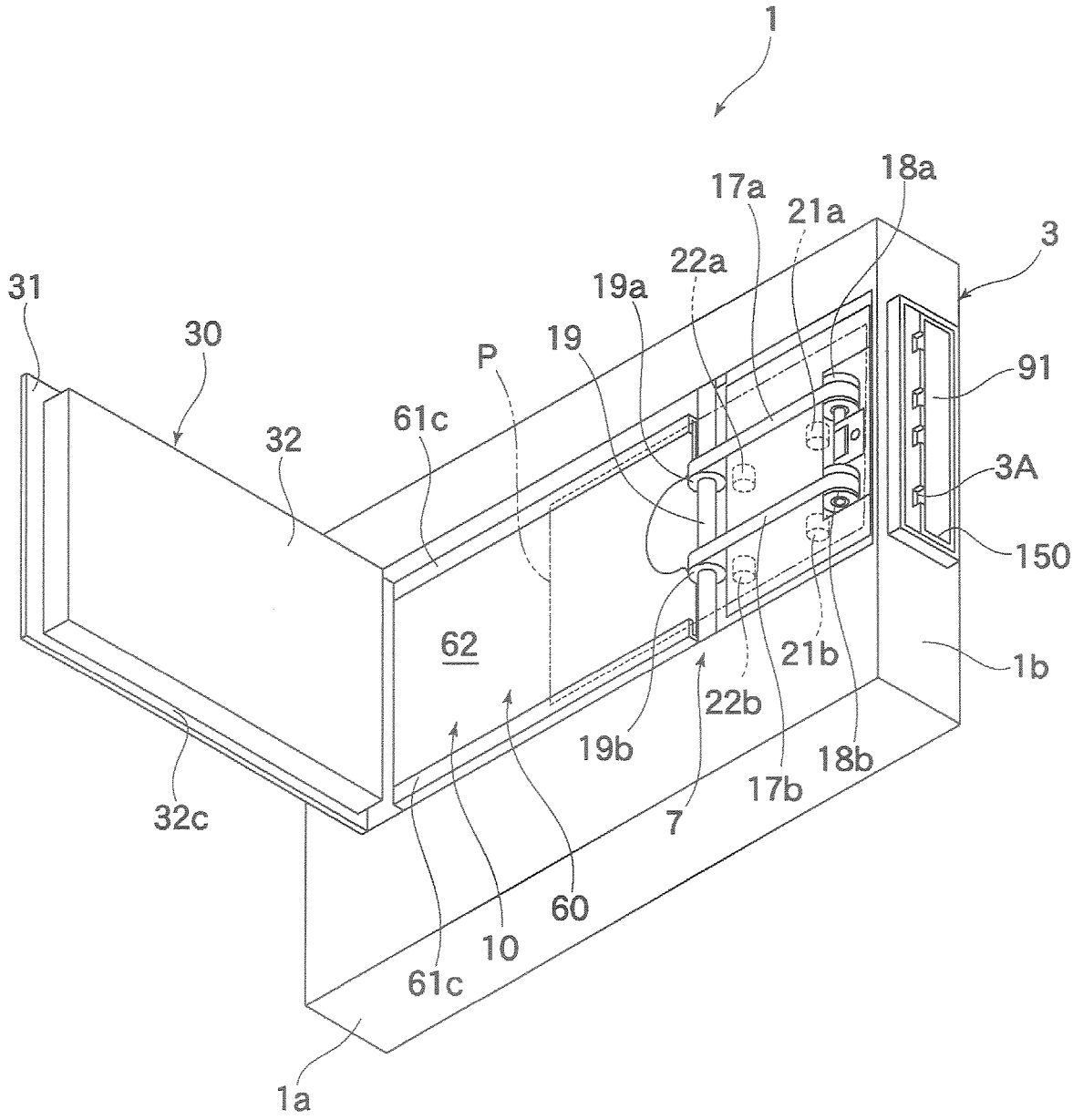
FIG. 2 is a perspective view of the arrangement shown in FIG. 1 when the lid is open.
Figure 3:
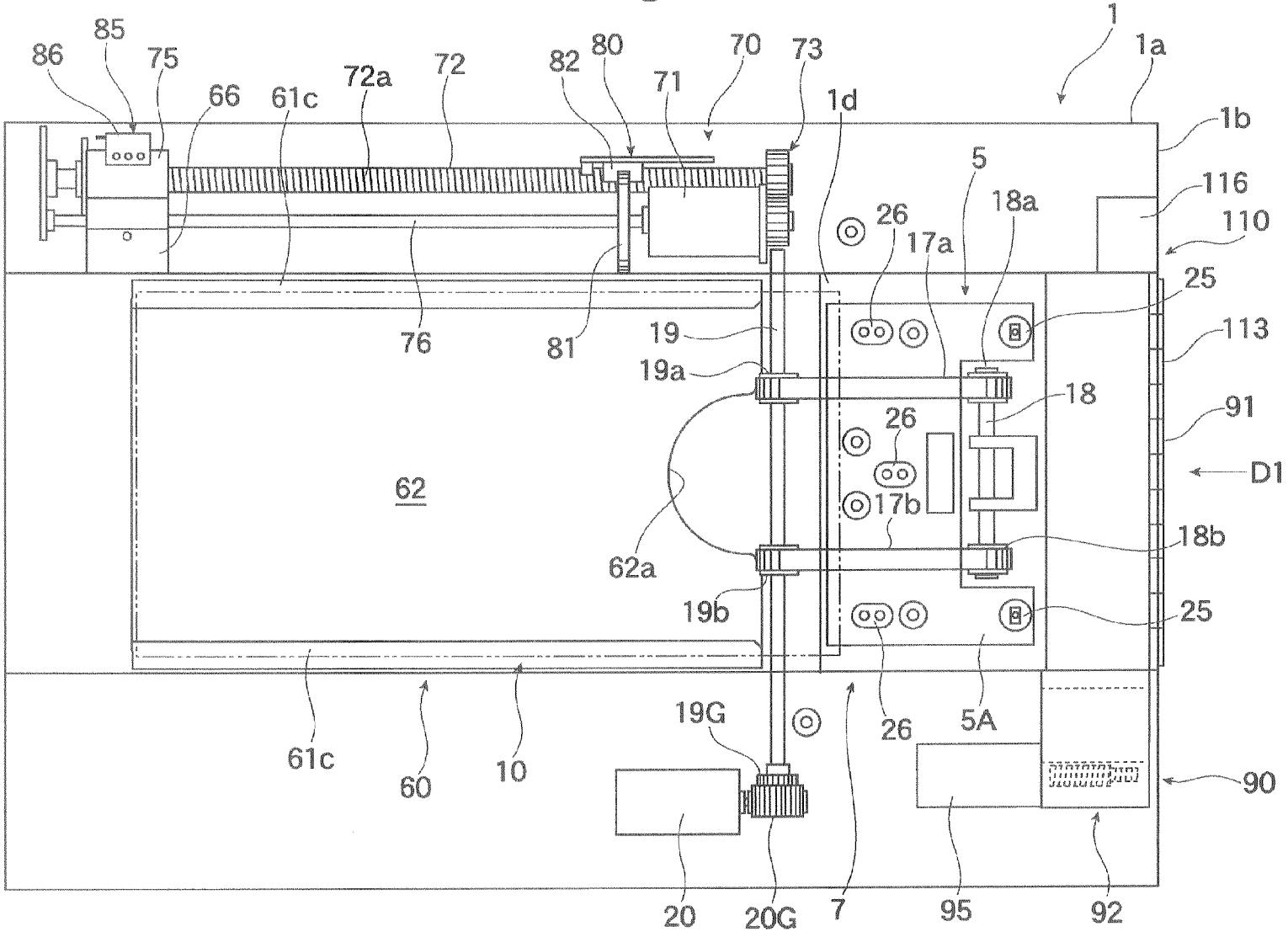
FIG. 3 is a plan view showing the internal arrangement of the bill handling device.

FIGS. 1 to 3 show the arrangement of the bill handling device according to this embodiment. FIG. 1 is a perspective view showing the overall arrangement. FIG. 2 shows the arrangement shown in FIG. 1 when the lid is open. FIG. 3 is a plan view showing the internal arrangement.

A bill handling device 1 is configured such that it can be disposed in a game medium dispensing device installed in between game machines such as Pachinko gaming machines (not shown). In this case, in the game medium dispensing device, other devices (for example, a coin discriminator, a recording medium handling device, and a power supply) are disposed above or below the bill handling device 1. The bill handling device 1 may be integrated with those devices or may be separately configured. Alternatively, the bill handling device 1 may be installed alone or together with the other devices in a space other than in between game machines. The bill handling device 1 then receives a bill, dispenses game mediums, if the inserted bill is validated, according to the value of the bill, and logs the record on a recording medium.

As shown in FIGS. 1 and 2, the bill handling device 1 has a rectangular box-like housing 1*a*, which is mounted on a locking portion of a game medium dispensing device (not shown). A bill handling area 3 is formed on the front side (the side to be exposed) 1*b* of the housing 1*a*. The bill handling area 3 includes a bill insertion slot 3A that is a slit opening for inserting a bill P and an openable/closable shutter 91 formed adjacent to the bill insertion slot 3A, through which a stacking tray (bill container) 60 for stacking and storing the bill P can be ejected. In this case, the bill P with its shorter side vertically aligned (in an upright position) is inserted through the bill insertion slot 3A along the arrow D1 direction.

As clearly shown in FIG. 3, in the housing 1*a* are provided a bill discriminator 5 for discriminating the validity of the inserted bill P and a bill transport mechanism 7 for transporting the inserted bill P. The bill discriminator 5 is disposed close to the bill insertion slot 3A in the insertion direction D1, and the bill transport mechanism 7 is disposed in the area starting from the bill discriminator 5 along the insertion direction D1. The bill transport mechanism 7 transports the inserted bill P while sandwiching it therein. The bill transport mechanism 7 is sized smaller than the longitudinal length of the bill P, preferably one half of the bill P or smaller and disposed in the area close to the bill insertion inlet 3A in the insertion direction D1.

Downstream of the bill transport mechanism 7 is provided a bill push area 10 where the bill P ejected by a pair of downstream rollers of the bill transport mechanism 7 is pushed in a sliding manner. The bill push area 10 has roughly the same size as the bill P such that the bill P ejected from the pair of downstream rollers can be pushed without any restriction or change in the arrow D2 direction that is perpendicular to the ejection direction. On opposite sides of the bill push area 10 thus located downstream of the bill transport mechanism 7 are provided a bill press mechanism 30 on one side of the housing 1*a* and a stacking tray 60 on the other side (see FIG. 2). Specifically, the bill P ejected by the transport operation of the bill transport mechanism 7 into the bill push area 10 is pressed in the arrow D2 direction by a press plate of the bill press mechanism 30 as will be described later, and successively stacked and stored in the stacking tray 60.

As particularly clearly shown in FIG. 3, the bill transport mechanism 7 includes a pair of transport belts 17*a* and 17*b* extending along the bill insertion direction D1 and spaced apart by a predetermined distance. On one side, i.e., on the bill insertion slot 3A side, the transport belts 17*a* and 17*b* engage tension rollers 18*a* and 18*b*, respectively, mounted on a shaft 18 rotatably supported on an internal frame 1*d*. On the other side, i.e., on the rear side of the bill discriminator 5, the transport belts 17*a* and 17*b* engage tension rollers 19*a* and 19*b*, respectively, mounted on a shaft 19 rotatably supported on the internal frame 1*d*.

The shaft 19 is rotated by a transport motor 20 disposed on the internal frame 1*d*. Specifically, the shaft 19 is rotated via a gear 19G that is mounted on one end of the shaft 19 and that engages a gear 20G mounted on the drive shaft of the transport motor 20. The transport motor 20 rotates in forward/reverse directions under the control of a controller, which will be described later, and functions as a drive source of the bill transport mechanism 7.

The tension rollers 18*a*, 18*b*, 19*a* and 19*b* abut pinch rollers 21*a*, 21*b*, 22*a* and 22*b*, respectively (see FIG. 2). That is, the bill P inserted through the bill insertion slot 3A is sandwiched between the transport belts 17*a*, 17*b* and the pinch rollers 21*a*, 21*b*, 22*a* and 22*b* abutted thereagainst and eventually transported to a nip portion between the pinch rollers 22*a*, 22*b* and the transport belts 17*a*, 17*b*, through which the bill P is ejected into the bill push area 10.

The bill discriminator 5 includes a sensor board 5A, on which a bill insertion detection sensor 25 is provided between the bill insertion slot 3A and the shaft 18. The bill insertion detection sensor 25 comprises, for example, an optical sensor and detects that a bill P was inserted in the bill insertion slot 3A. When the bill insertion detection sensor 25 detects that the bill P has been inserted, a controller, which will be described later, rotates the transport motor 20 in the bill feed direction (forward direction).

On the sensor board 5A is also provided a bill discrimination sensor 26 between the shafts 18 and 19. The bill discrimination sensor 26 comprises an optical sensor and projects light onto the bill P transported by the bill transport mechanism 7. A plurality of bill discrimination sensors 26 is disposed along the direction perpendicular to the bill insertion direction D1. The detected data in the form of reflected or transmitted light from the bill P is sent to a CPU in the controller, which will be described later. The CPU compares the detected data with genuine bill data pre-stored in a ROM and determines whether or not the bill is genuine.

As stated above, a bill press mechanism 30 is provided on one side of the housing 1*a*. The bill press mechanism 30 includes a lid 31 that opens and closes with respect to the housing 1*a*, a press plate 32 that is provided on the lid 31 and presses the bill P in the arrow D2 direction when the lid 31 is closed with respect to the housing 1*a* and the bill P is positioned in the bill push area 10, and a plate drive motor 33 for driving the press plate 32.

Figure 4:
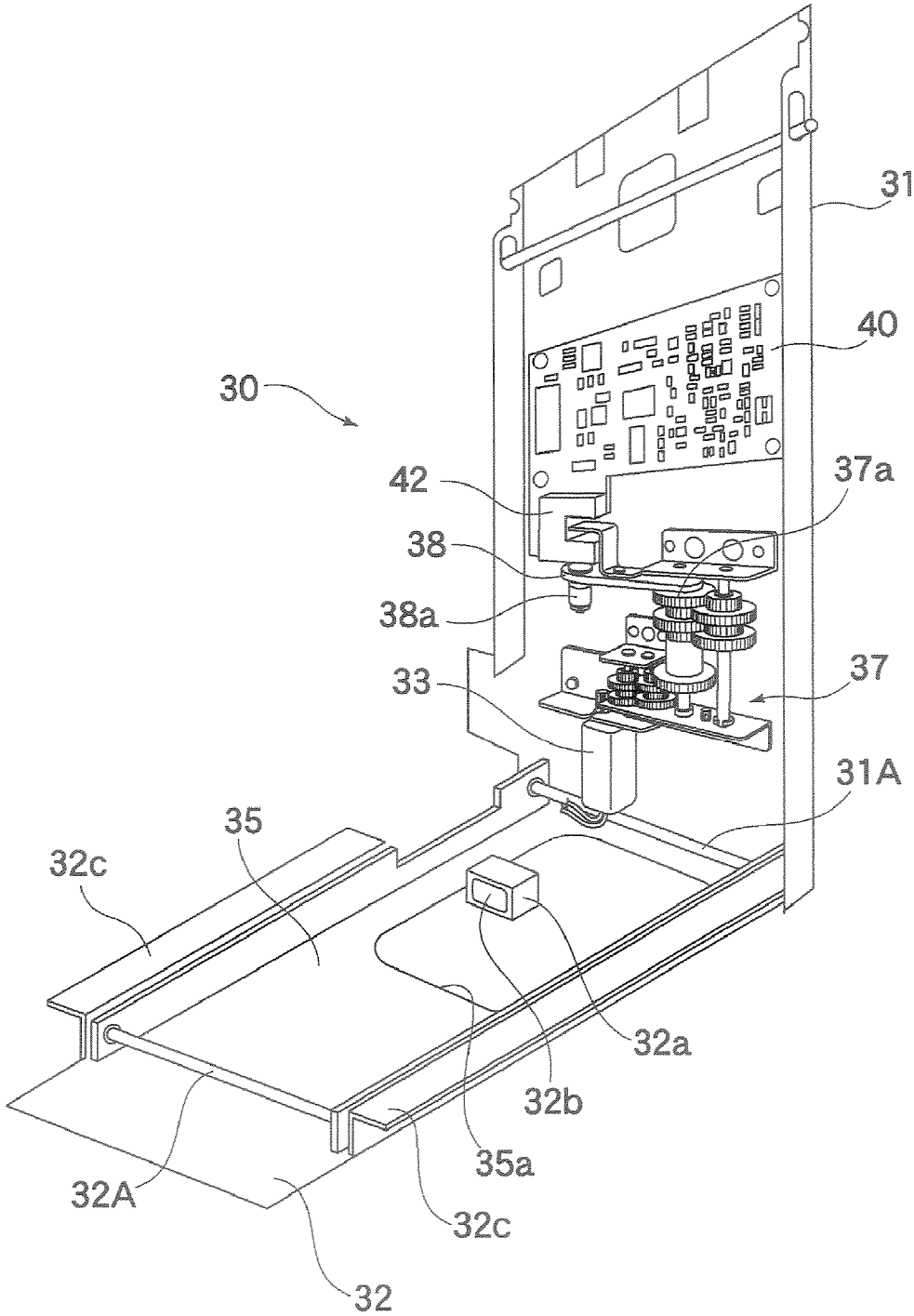
FIG. 4 shows the arrangement of the bill press mechanism when the press plate is released from the lid.
Figure 5:
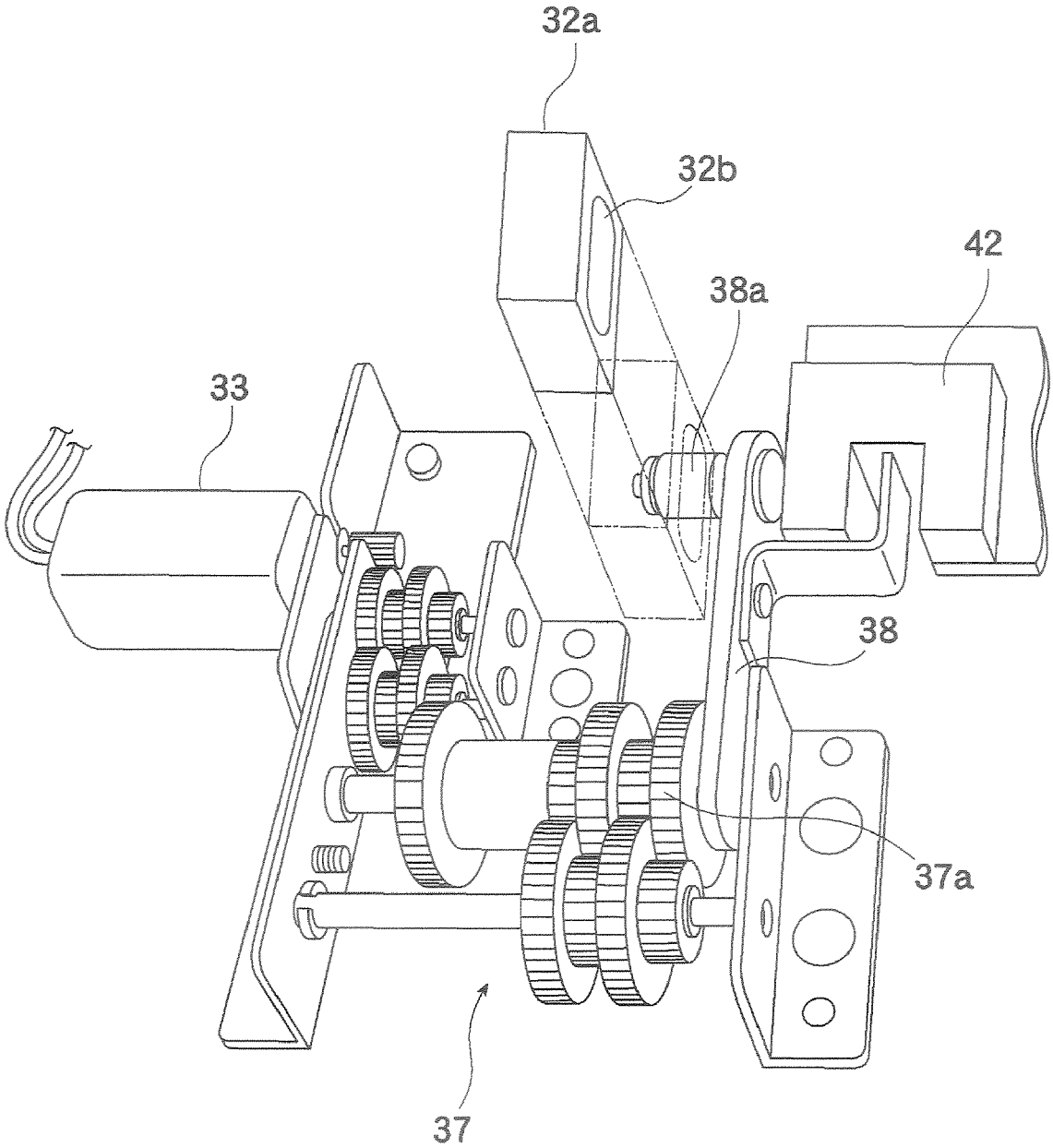
FIG. 5 shows the arrangement of the plate drive motor and the deceleration mechanism thereof.
Figure 6:
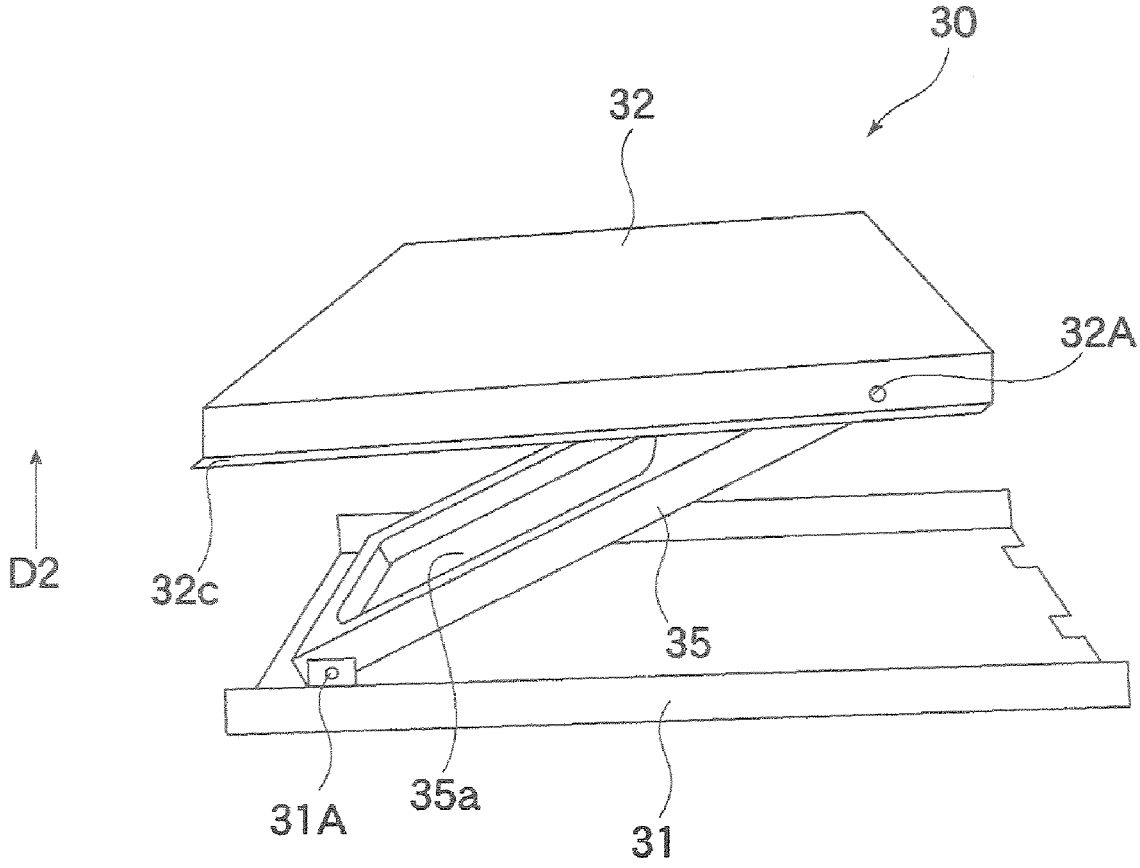
FIG. 6 shows the arrangement of the link mechanism connecting the press plate and the lid.
Figure 7A:
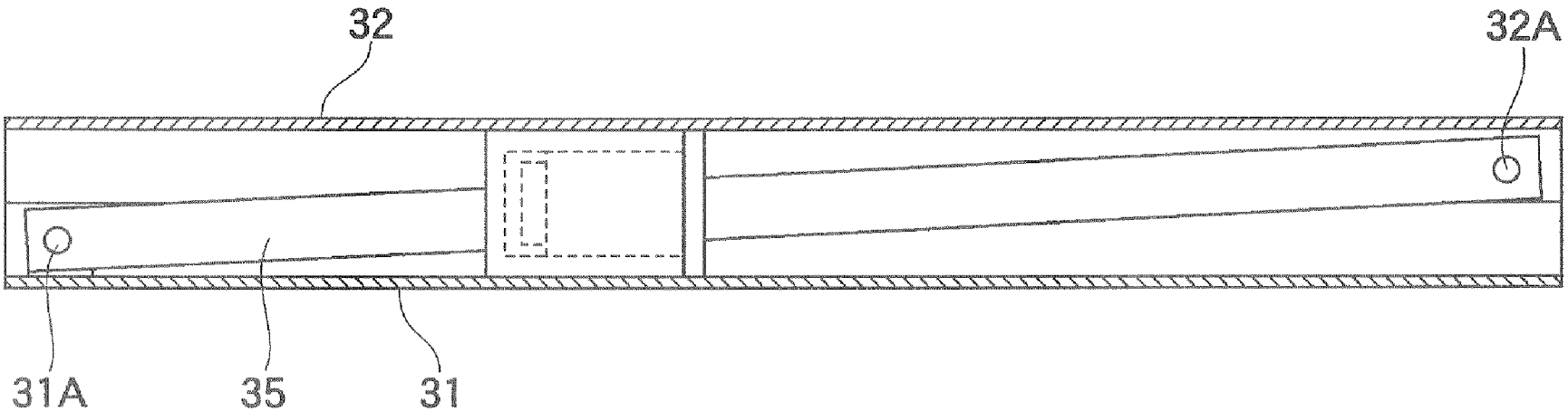
FIG. 7A shows the operation of the press plate in the non-pressing mode.
Figure 7B:
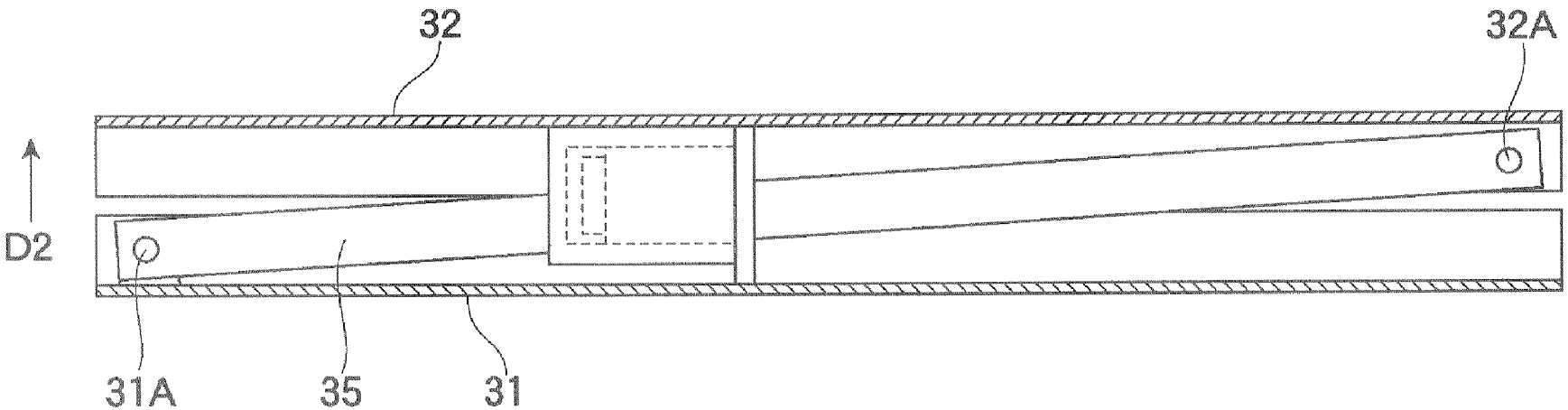
FIG. 7B shows the operation of the press plate in the pressing mode.

The arrangement of the bill press mechanism 30 will be described below with reference to FIGS. 4 to 7. FIG. 4 shows the arrangement when the press plate 32 is released from the lid 31. FIG. 5 shows the arrangement of the plate drive motor 33 and the deceleration mechanism 37 thereof. FIG. 6 shows the arrangement of the link mechanism connecting the press plate 32 and the lid 31 (the control circuit board and the like are omitted). FIGS. 7A and 7B show the operation of the pressing plate 32 in non-pressing and pressing modes, respectively.

The press plate 32 has roughly the same size as the bill P and is supported on the lid 31 movably in the arrow D2 direction by a link member 35 connecting one side of the rear of the press plate 32 and the opposite side of the rear of the lid 31 (see FIG. 6). The link member 35 is pivotably supported on both sides by shafts 31A and 32A provided on the lid 31 and press plate 32, respectively (that is, the press plate 32 is supported only on one side of the lid 31). The link member 35 thus configured supports the press plate 32 such that the press plate 32 moves toward and away from the lid 31 as shown in FIGS. 6 and 7.

As shown in FIG. 4, the plate drive motor 33 is disposed on the rear of the lid 31. The rotary motion of the plate drive motor 33 pivots a push-down arm 38, which will be described later, and the pivotal motion is then converted to a reciprocal motion of the press plate 32 in the arrow D2 direction.

Specifically, on the rear of the lid 31 are provided a deceleration mechanism (gear train) 37 for decelerating the rotary motion of the plate drive motor 33 and transmitting the decelerated rotary motion to the press plate 32, and the push-down arm 38 that is pivoted by a final gear 37*a* of the deceleration mechanism 37 (see FIGS. 4 and 5). The final gear 37*a* is fixed to the base end of the push-down arm 38 such that it is pivoted around its base end, At the front end of the push-down arm 38 is fixed an engage projection 38*a*, which engages an elongated groove 32*b* formed in a projection member 32*a* mounted on the rear of the press plate 32. The pivotal motion of the push-down arm 38 around its base end displaces the engage projection 38*a* along the elongated groove 32*b*, which is then converted to a reciprocal motion of the press plate 32 along the arrow D2 direction while it maintains a parallel relationship with the lid 31. To maintain a good parallel reciprocal motion of the press plate 32, the pivotal motion of the push-down arm 38 that presses the press plate 32 at one location is restricted to up to 45 degrees. As shown in FIG. 4, the projection member 32*a* is exposed through an aperture 35*a* formed in the link member 35 such that the projection member 32*a* does not interfere with the motion of the link member 35.

The press plate 32 is shaped such that it hangs down a predetermined length toward the press direction (the direction D2) and a flange (overhang) 32*c* is formed on each side of the press plate 32 along the longitudinal direction. When the press plate 32 is moved by the push-down arm 38 in the push-down direction and enters the opening of the stacking tray 60 (which will be described later) to a certain depth, both the flanges 32*c* abut stopper wings 61*c* of the stacking tray 60 (which will be described later), preventing the press plate 32 from entering the opening of the stacking tray 60 any further (see FIG. 9). Providing such flanges 32*c* allows the press plate 32, although only one side of which is supported by the link member 35, to ultimately become parallel to the bill P due to the abutment between the flanges 32*c* and the stopper wings 61*c*, and uniformly press the bill P along the longitudinal direction. Providing such flanges 32*c* also corrects possible slight front-to-back inclination of the press plate 32, which may occur even though the push-down arm 38 tries to keep it parallel to the bill P, allowing the bill P to be reliably stored in the stacking tray 60 independent of the state of the bill P (such as crinkles, crimps, or warp).

In this embodiment, on the rear of the lid 31 is disposed a control circuit board 40 (forming the controller) for controlling the motions of various drive mechanisms in the bill handling device 1. The control circuit board 40 is connected to an optical sensor (pivotal motion detection sensor) 42 for detecting the pivotal travel of the push-down arm 38 (see FIGS. 4 and 5). The optical sensor 42 is used to stop the motion of the plate drive motor 33 when the pivotal travel of the push-down arm 38, i.e., the travel of the press plate 32 in the push-down direction reaches a predetermined threshold value. This prevents an unnecessary load from acting on the plate drive motor 33.

The stacking tray 60 is provided on the opposite side of the housing 1*a* from the bill push area 10, as shown in FIGS. 2 and 3 The stacking tray 60 is configured to successively stack and store the bill P pressed by the press plate 32. The arrangement of the stacking tray 60 is described below with reference to FIGS. 8 and 9.

Figure 8A:
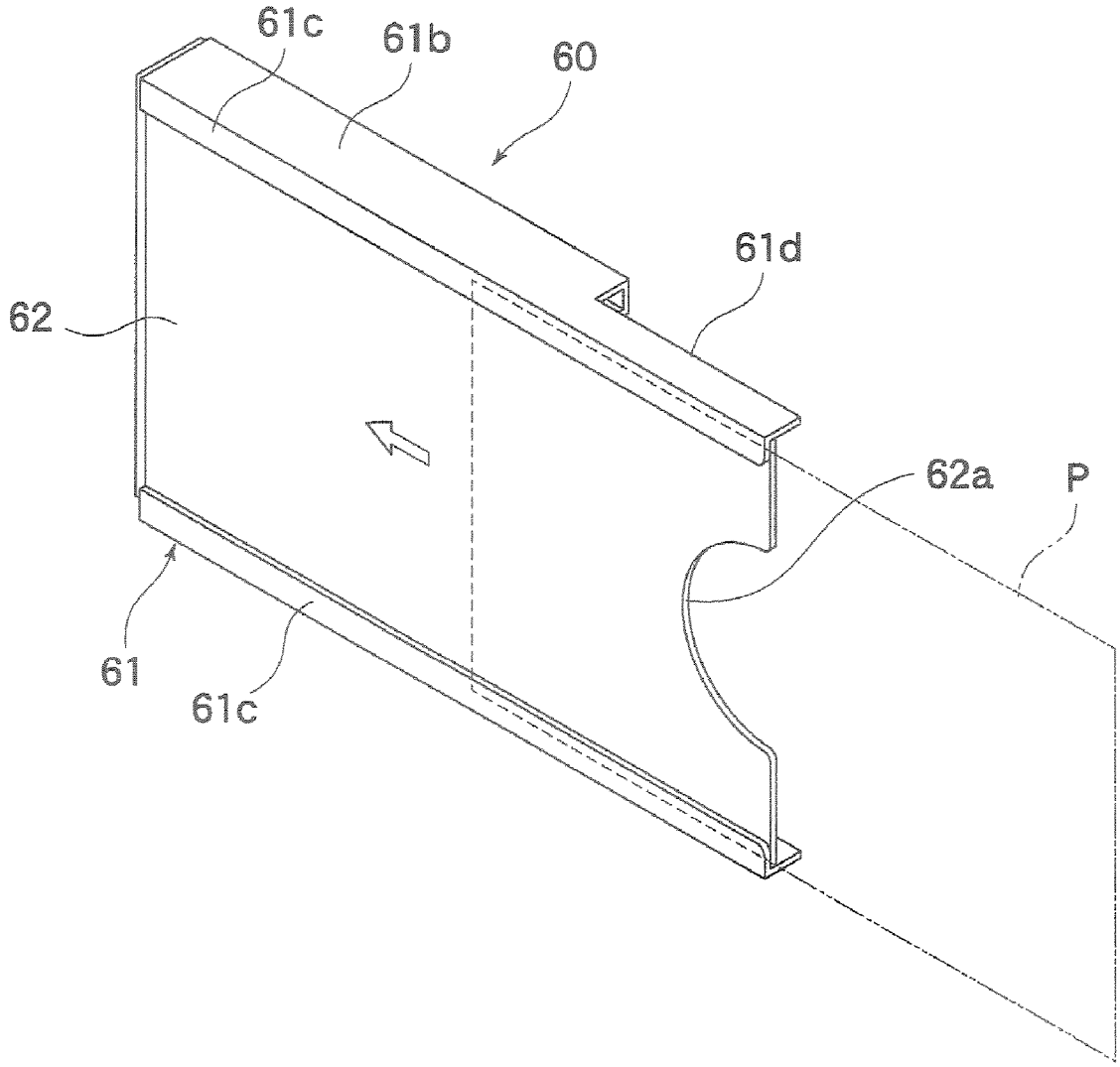
FIG. 8A is a perspective view showing the arrangement of the stacking tray when the bill is ejected in the bill push area.
Figure 8B:
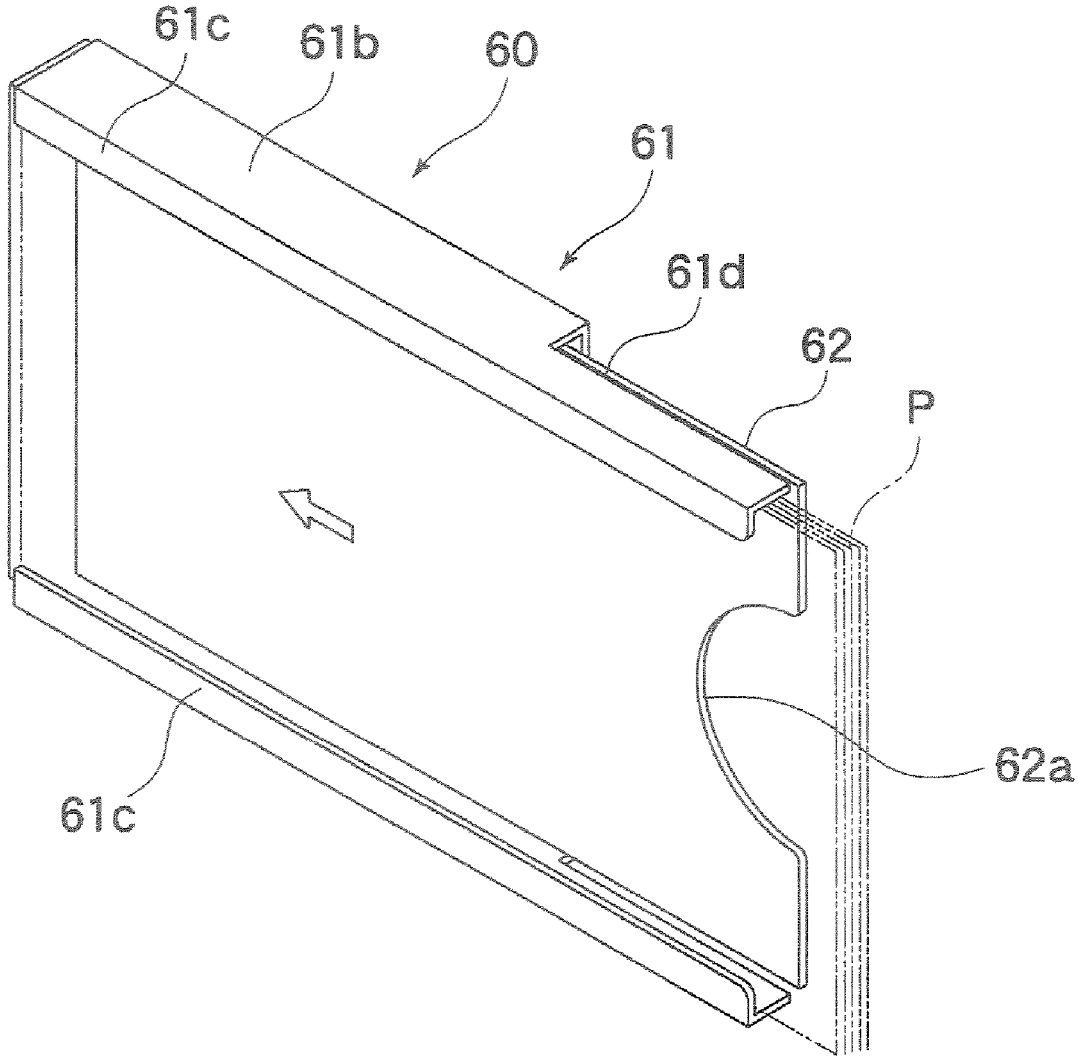
FIG. 8B is a perspective view showing the arrangement of the stacking tray when the bill is stacked and stored.

The stacking tray 60 includes a body 61 having a bottom wall 61*a* and side walls 61*b* formed on both sides of the bottom wall 61*a*. Between the side walls 61*b* of the body 61 is provided a stacking plate 62 for stacking bills. The stacking plate 62 is pressed and biased in the press direction by a biasing spring 63 disposed between the stacking plate 62 and the bottom wall 61*a* of the body 61. On the opening side of the side walls 61*b* is formed a pair of stopper wings 61*c* projecting inward and extending along the longitudinal direction of the bill P to be stored. The stopper wings 61*c* function to separate the bill ejected in the bill push area 10 through the bill transport mechanism 7 from the bills stored in the body 61, as shown in FIGS. 8A and 9A. Specifically, when the press plate 32 presses the bill P ejected in the bill push area 10, the center of the bill P is bent due to the presence of the stopper wings 61*c* and pushed to the stacking plate 62, as shown in FIG. 9B Then, the bill P passes over the stopper wings 61*c* and is stacked on the stacking plate 62 against the biasing force of the biasing spring 63, as shown in FIGS. 8B and 9C. When the press plate 32 returns to its initial position, the edges of the bills stacked and stored on the stacking plate 62 are pressed against the pair of stopper wings 61*c* by the biasing force of the biasing spring 63. A gap R is then formed between the topmost bill stacked and stored on the stacking plate 62 and the press plate 32, as shown in FIG. 9A, to consequently separate the stacked and stored bills from the press plate 32. The gap R is formed to receive the bill P ejected from the bill transport mechanism 7, and the bill P delivered in the gap R is stacked and stored in the stacking tray 60 by the motion of the press plate 32 from its initial position as described above.

Too large gap R may cause bill jamming when the bill P is crinkled or the like, while too small gap R prevents the bill P from being stably delivered. Specifically, a preferable size of the gap R ranges approximately from 3 to 5 mm. In the bill push area 10, the bill press mechanism 30 and stacking tray 60 are preferably disposed such that such a gap R is formed.

In this embodiment, the bills P stacked and stored in the body 61 of the stacking tray 60 are held by the pressed and biased stacking plate 62 as well as the stopper wings 61*c*, and such a configuration allows the front end of the bills to be exposed (see FIG. 8B). Thus, as described later, when the front end portion of the stacking tray 60 is driven to project from the front side 1*b* of the housing 1*a*, the front end portion of the bills stacked and stored on the stacking plate 62 is exposed (see FIG. 15), allowing the operator easily to pick the bills frontward and collect them.

Specifically, the longitudinal length (the length of the bill stacking plane) of the body 61 (stacking plate 62) is preferably shorter than the length of the bill P to be inserted, as shown in FIG. 8B By thus reducing the length of the stacking plate 62, the front end portions of the top and bottom of the bills stacked and stored on the stacking plate 62 are exposed, allowing the operator to easily grab and pick the bills out. Furthermore, with such a configuration, the operator does not have to touch the stacking plate 62 formed of metal, such as stainless steel (e.g., SUS), with the fingers, resulting in increased safety when collecting the bills. Moreover, as shown in FIG. 8, a recess 62*a* may be formed at the center of the front edge of the stacking plate 62. Such a configuration also allows the operator to grab the bills more easily and again a similar advantage described above can be obtained.

The portions of the side walls 61*b* of the body 61 that face the housing 1*a* on the front side are cut to form cutouts 61*d* extending a predetermined length in the bill insertion direction. Those cutouts 61*d* are provided such that when the shutter 91 is released by a shutter mechanism, which will be described later, and the stacking tray 60 is moved in the direction in which it projects, the shutter 91 in the open position will not interfere with the body 61, effectively allowing those components to be configured in a space-efficient manner. In the stacking tray 60, a bill detection sensor 128 for detecting the presence of a bill P (see the block diagram of FIG. 14) may be provided on the stacking plate 62.

A stacking tray drive mechanism 70 for driving the stacking tray 60 will be described with reference to FIGS. 3 and 10.

The stacking tray drive mechanism 70 includes a tray drive motor 71 fixed on the internal frame 1*d* of the housing 1*a* and a drive shaft (worm shaft) 72 that is rotated by the tray drive motor 71. The drive shaft 72 extending in the bill insertion direction (direction D1) is rotatable supported on the internal frame 1*d*. A male thread 72*a* is formed on the outer surface of the drive shaft 72. One end of the drive shaft 72 is connected to the output shaft of the tray drive motor 71 via a gear train 73.

At the rear end portion of the body 61 of the stacking tray 60 is formed a connecting piece 66, which is connected to a sliding member 75 disposed such that it encloses the drive shaft 72. The sliding member 75 has a female thread (not shown) that engages the male thread 72*a* of the drive shaft 72. The rotary motion of the drive shaft 72 is converted to a reciprocal motion of the sliding member 75, i.e., the stacking tray 60, along the axial direction. A guide rod 76 disposed parallel to the drive shaft 72 is inserted through the sliding member 75 to prevent the sliding member 75 from rotating when it moves back and forth.

The stacking tray drive mechanism 70 also includes a travel detection module 80 capable of detecting the travel of the stacking tray 60. The travel detection module 80 may include a disc-like rotary member 81 mounted on the opposite output shaft of the tray drive motor 71, and a rotational travel detection sensor (optical sensor) 82 disposed such that it sandwiches the rotary member 81 with a predetermined gap on each side thereof. The rotary member 81 is formed as an encoder 81*a* with a plurality of detection openings circumferentially provided at a predetermined interval. As the tray drive motor 71 rotates the encoder 81*a* (rotary member 81), the rotational travel detection sensor 82 can obtain pulses corresponding to the rotational travel. Therefore, the travel of the stacking tray 60 can be obtained based on the number of the pulses. By providing such a travel detection module 80, it is possible to accurately control the stop position of the stacking tray 60 in the direction in which it projects and reduce the load on the tray drive motor 71.

The stacking tray drive mechanism 70 also includes a position detection module 85 capable of detecting the storing position for the stacking tray 60 (the position where a bill is allowed to be stored). Such a position detection module 85 may include a stopper (not shown) provided on the sliding member 75 that moves the stacking tray 60, and a limit switch 86, mounted on the internal frame 1*d*, that the stopper presses and releases to change ON and OFF states thereof. By providing such a position detection module 85, it is possible to provide the state of the stacking tray 60 (whether it is in the storing position or in the collecting position) and appropriately drive the stacking tray 60 during the bill collection process.

In this embodiment, the bills P stacked and stored in the stacking tray 60 can be collected in the bill handling area 3 by releasing a shutter mechanism 90 disposed adjacent to the bill insertion slot 3A. The arrangement of the shutter mechanism 90 will be described below with reference to FIGS. 2, 3, and 11 to 13.

The shutter mechanism 90 includes the openable/closable shutter (blocking plate) 91 that closes the exit 150 that is a rectangular opening formed in the bill handling area 3, and a shutter drive mechanism (shutter drive module) 92 for pivoting (opening and closing) the shutter 91. The shutter 91 is formed as a generally rectangular plate member and its base end is fixed on a shaft 91*a* rotatably supported on the internal frame 1*d* of the housing 1*a*.

The shutter drive mechanism 92 includes a shutter drive motor 95, which is connected to the shaft 91*a* via a gear train 96 and link arm members 97*a*, 97*b* sequentially connected to the gear train 96. The gear train 96 forms a deceleration mechanism connected to a drive shaft 95*a* of the shutter drive motor 95. Therefore, the shutter drive motor 95 rotates its drive shaft 95*a* and the resulting rotational driving force is decelerated through the gear train 96. An output gear 96*a* of the gear train 96 is connected to a shaft of the link member 97*a* and the forward rotation of the shutter drive motor 95 pivots the link member 97*a*, changing its state shown in FIG. 13A to the state shown in FIG. 13B. The link member 97*a* is connected to the front end of the link member 97*b* and the base end of the link member 97*b* is connected to the shaft 91*a*. The pivotal motion of the link member 97*a* as shown in the figure pivots the shutter 91 via the link member 97*b* approximately by 90 degrees from the upright position toward into the housing.

The shutter drive mechanism 92 also includes a pivotal travel detection module 100 capable of detecting the pivotal travel of the shutter 91. The pivotal travel detection module 100 may include an encoder with a plurality of detection apertures 101 circumferentially formed at a predetermined interval in the surface of an input gear 96*b* of the gear train 96 and a rotational travel detection sensor (reflective optical sensor) 102 for detecting the rotational travel of the encoder. By providing such a pivotal travel detection module 100, it is possible to accurately control the stop position of the shutter 91 when the shutter 91 is pivoted and its pivotal angle reaches approximately 90 degree and reduce the load on the shutter drive motor 95.

In this embodiment, to work with the shutter mechanism 90, a lock mechanism 110 is also provided for holding the shutter 91 at its closed position.

The lock mechanism 110 includes projections and recesses 112 successively formed on the upper edge of the openable/closable shutter 91 along the longitudinal direction, a lock plate (lock member) 113 supported on the internal frame 1*d* of the housing 1*a* (specifically, slotted in a groove of the housing 1*a*) and movable along the longitudinal direction of the shutter 91 (the direction indicated by the arrow), a drive module (lock member moving module), such as a solenoid 116, that moves the lock late 113 along its longitudinal direction (the longitudinal direction of the shutter 91).

The lock plate 113, on the side adjacent to and facing the shutter 91 (along the moving direction of the lock plate 113), has recesses and projections 114 that engage the projections and recesses 112. The lock plate 113 is always biased by a biasing spring (biasing module) 117 such that the projections and recesses 112 and the recesses and projections 114 do not coincide (that is, biased to the locked position where the lock plate 113 prevents the shutter 91 from opening) (see FIG. 12). To collect the bills P, the solenoid 116 drives the lock plate 113 against the biasing force of the biasing spring 117 such that the projections and recesses 112 and the recesses and projections 114 coincide (see FIG. 11). This releases the locked shutter 91 (that is, the lock plate 113 is positioned at the unlocked position where the shutter 91 is allowed to open) and allows the shutter drive mechanism 92 to pivot the shutter 91 into the housing 1*a*, making the stacking tray 60 ready to eject.

FIG. 14 is a block diagram showing an exemplary arrangement of the controller for controlling the operation of the bill handling device 1.

The controller includes, as described above, the control circuit board 40 mounted on the rear of the lid 31 for controlling the operations of the various actuators described above. The control circuit board 40 includes a CPU 130 having functions to control the operations of various drive units, such as the transport motor 20, plate drive motor 33, tray drive motor 71, shutter drive motor 95, and solenoid 116, a ROM 131 for storing programs for actuating the various drive units, data for detecting genuine bills and the like, and a control RAM 132.

The CPU 130 is connected to motor drive circuits 140 to 143 for driving the various motors via an I/O port 135. The operations of the drive motors (driving the motors in the forward or reverse direction, and stopping the motors) are controlled using control signals from the CPU 130 based on the programs for actuating those motors. The CPU 130 receives detection signals via the I/O port 135, such as a bill insertion detection signal from the bill insertion detection sensor 25, a bill discrimination signal from the bill discrimination sensor 26, a press position detection signal for the press plate 32 from the pivot motion detection sensor 42, a position detection signal for the stacking tray 60 from the pivotal travel detection sensor 82, a detection signal from the limit switch 86 detecting whether or not the stacking tray 60 is in the storing position, and a pivotal position detection signal for the shutter 91 from the rotational travel detection sensor 102. Based on these detection signals, the operations of the transport motor 20, plate drive motor 33, tray drive motor 71, shutter drive motor 95, and solenoid 116 are controlled.

The CPU 130 is connected to a control circuit 200 disposed in the body of the game machine (not shown) and executing the game, and sends the game machine the information on how much the player is worth playing the game based on the value of the bill inserted.

Furthermore, the CPU 130 on the control circuit board 40 receives a release signal for releasing the lock mechanism 110 in the locked mode (for driving the solenoid 116). A signal transmission module 300 for transmitting the release signal can be, for example, configured as part of functions of a management server connected over a communication network 400 and managing the facility in a bank, allowing, for example, the shutters 91 of the bill handling devices in the bank facility to be released in a single operation during the collection process.

The operation of the bill handling device 1 configured as described above will now be described.

First, the procedure of successively stacking and storing bills P in the stacking tray 60 will be described. As shown in FIGS. 1 to 3, the bill P with its shorter side vertically aligned in an upright position is inserted through the bill insertion slot 3A, which is detected by the bill insertion detection sensor 25. When the bill insertion detection sensor 25 detects that the bill P has been inserted, the transport motor 20 is rotated in the forward direction and the bill P is sandwiched by the transport belts 17*a*, 17*b* and the pinch rollers 21*a*, 21*b*, 22*a*, 22*b* abutted thereagainst, which are part of the bill transport mechanism 7, and transported into the housing 1*a*.

While the bill P is being transported in the housing 1*a*, the bill discrimination sensor 26 detects the bill P and the controller determines its validity. If the bill discrimination sensor 26 cannot determine the validity of the bill P, the transport motor 20 is counterrotated to return the bill P being transported and eject it from the bill insertion slot 3A.

When the bill P is validated, the transport motor 20 is rotated until the rear edge of the bill P passes through the nip portion between the transport belts 17*a*, 17*b* and the pinch rollers 22*a*, 22*b*. At the same time, as shown in FIGS. 8A and 9A, in the bill push area 10 located downstream of the transport belts 17*a*, 17*b* and the pinch rollers 22*a*, 22*b*, the bill P is ejected in the gap R between the press plane of the press plate 32 and the plane including the stopper wings 61*c* of the stacking tray 60. As mentioned above, the gap R is set in a certain range such that the gap does not cause jamming or the like.

When the bill P passes through the nip portion and reaches the push area 10, the forward rotary motion of the transport motor 20 is stopped and the plate drive motor 33 is rotated. The push-down arm 38 then drives the press plate 32 in the push-down direction and the bottom side of the press plate 32 presses the bill P (see FIG. 9B). The bill P being pressed by the press plate 32 passes over the pair of stopper wings 61*c* of the stacking tray 60 and gets pressed on the stacking plate 62 against the biasing force of the biasing spring 63. Although the press plate 32 provides different pressing forces at different positions of the bill depending on the supporting position of the link member 35, the flanges (overhangs) 32*c* formed on both sides of the press plate 32 touch the stopper wings 61*c*, providing a substantially uniform pressing force on the bill P along the longitudinal direction. That is, the entire bill can be uniformly pressed, ensuring that a predetermined number of bills can be stored even when the bill is crimped or hard to be straightened (due to the increased number of the stacked bills). The position of the push-down arm 38 is detected by the pivotal motion detection sensor 42, which detects an appropriate position of the push-down arm 38 (when the flanges 32*c* of the press plate 32 touch the stopper wings 61*c*) and stops the plate drive motor 33. After a predetermined pressing force is applied to the press plate 32 and the flanges (overhangs) 32*c* touch the stopper wings 61*c*, the plate drive motor 33 is counterrotated to return the press plate 32 to its initial position. At the same time, the stacking plate 62 is biased to the stopper wings 61*c* by the biasing force of the biasing spring 63 and the topmost bill P touches the stopper wings 61*c* as shown in FIG. 9C. The bill is now separated from a bill to be subsequently delivered. By repeating the above operations, bills P will be stably stacked and stored on the stacking plate 62 of the stacking tray 60.

The procedure of collecting the bills P stored in the stacking tray 60 will now be described. When collecting the bills P, the management server (signal transmission module 300) for managing the entire parlor, for example, sends a signal for releasing the lock mechanism 110 to each bill handling device 1 installed in a bank. In this case, the management server may, for example, control all the bill handling devices 1 in the bank to release the lock mechanisms 110 thereof, or may control the bill handling devices 1 in one row in the bank to release the lock mechanisms 110 thereof. When the bill handling machine 1 receives this release signal, it drives the solenoid 116, which in turn drives the lock plate 113 in the longitudinal direction of the shutter 91 against the biasing force of the biasing spring 117. Thereby, the recesses and projections 114 of the lock plate 113 and the projections and recesses 112 formed on the shutter 91 coincide. The rotary motion of the shutter drive motor 95 drives the shutter 91 into the open position where the shutter 91 is pivoted into the housing 1*a* (see FIG. 13B). The rotational travel of the shutter drive motor 95 is detected by the rotational travel detection sensor 102, which stops the shutter drive motor 95 at an appropriate position (a position where the shutter pivots about 90 degrees into the bowed-down position).

When the shutter drive motor 95 is stopped, the tray drive motor 71 is rotated, which ejects the front end portion of the stacking tray 60 from the front side of the housing 1*a*. As described above, since cutouts 61*d* are formed on both the side walls 61*b* of the body 61 of the stacking tray 60, the front end portion of the stacking tray 60 is ejected (projected) through the exit 150 without interfering with the shutter 91 in the bowed-down position. The rotational travel of the tray drive motor 71 is detected by the rotational travel detection sensor 82, which stops the stacking tray 60 at an appropriate position.

While the motion of the stacking tray 60 is stopped, the bills stacked on the stacking plate 62 are held such that the front end portion of the bills is exposed as shown in FIG. 15, allowing the operator to grab and pick the exposed bills out and the bill collection process to be carried out in an efficient manner. In particular, in this embodiment as shown in FIG. 8, the length of the stacking plate 62 on which the bill P is stacked is shorter than the length of the bill P, and in addition, the recess 62*a* is formed at the center of the front edge of the stacking plate 62. Therefore, when the stacking tray 60 projects, the bills stacked and stored can be easily grabbed at their front portion, allowing the collection process of the bills P to be carried out more easily.

During the collection process of the bills P, when the bill detection sensor 128 detects that no bill P exists on the stacking plate 62 (when the collection is completed), the above procedure is performed in a reverse order after a predetermined period of tire has passed. That is, the tray drive motor 71 is counterrotated to return the stacking tray 60 to its storing position. When the limit switch 86 detects the presence of the stacking tray 60, the shutter drive motor 95 is counterrotated to pivot the shutter 91 into the closed position. Thereafter, the solenoid 116 is de-energized to return the lock plate 113 to its initial position, and the lock mechanism 110 is actuated.

Since the absence of a bill on the stacking plate 62 is detected and the lock mechanism 110 is automatically actuated as described above, the operator has nothing to do but collect bills, allowing the bill collection process to be carried out in an efficient manner. Such an arrangement reliably eliminates the possibility that the operator forgets to lock the shutter 91 (human error) in the bill collection process, resulting in increased security.

The controller described above may be configured such that when it receives the signal for releasing the lock mechanism 110 but no bill P exists on the stacking plate 62, the controller will not release the lock mechanism 110. That is, when no bill P exists, the stacking tray 60 will not be driven and the locking state of the lock mechanism 110 is maintained, reliably eliminating the possibility that the operator forgets to actuate the lock mechanism.

The process of releasing the lock mechanism 110 described above may be carried out through a dedicated mobile terminal in possession of the operator. For example, each bill handling device 1 may have an infrared light receiver 500 (see FIGS. 1 and 14), through which the lock mechanism 110 is released when the infrared light receiver receives a predetermined lock release signal from the mobile terminal. That is, with such an arrangement, the collection process can be carried out for a large number of bill handling devices by releasing the individual lock mechanisms. Alternatively, such a release operation may be carried out in a single operation using the mobile terminal via the management server. That is, the lock mechanisms may be released for the entire bank or for each one row in the bank in a single operation using the mobile terminal.

As described above, since the bill handling device 1 of this embodiment includes the exit 150 for projecting the stacking tray 60, which is a bill container, out of the housing 1*a*, the openable/closable shutter 91 that closes the exit 150, and the lock plate 113 movable between the locked position where the shutter 91 is not allowed to open and the unlocked position where the shutter 91 is allowed to open, the lock plate 113 can be moved to the locked position to prevent the shutter 91 from opening, preventing the stacking tray 60 from being removed through the exit 150 as well as the bills P from being directly removed from the stacking tray 60 through the exit 150. In other words, the bills P can be essentially protected from being removed, providing a highly secure bill handling device.

In the bill handling device 1 according to this embodiment, since the lock plate 113 is always held in the locked position with the biasing spring 117 as a biasing module, the bills P can be more securely protected from being removed.

Furthermore, in the bill handling device 1 according to this embodiment, since the locking and unlocking are performed through the engagement and disengagement between the recesses and projections 114 of the lock plate 113 and the projections and recesses 112 of the shutter 91, less travel of the lock plate 113 can actuate the lock mechanism in an efficient and effective manner, ultimately allowing the size of the device to be reduced.

Moreover in the bill handling device 1 according to this embodiment, since the pivotal motion of the shutter 91 into the housing 1*a* opens the exit 150, only the stacking tray 60 projects out of the exit 150 and the shutter 91 will not block the bill collection from the stacking tray 60, allowing the bills P to be collected in a quick and efficient manner. Furthermore, in this embodiment, since cutouts 61*d* are provided on the stacking tray 60 along its projection direction to avoid its interference with the shutter 91, the pivotal motion of the shutter 91 into the housing 1*a* will not interfere with the projecting motion of the stacking tray 60.

It should be noted that the invention is not limited to the above described embodiments but can be practiced with various modifications made thereto within the spirit thereof. For example, the component members, such as the various drive mechanisms and sensors, disposed in the housing are merely one example and their specific configurations can be modified as appropriate as long as they provide similar processes and operations. The configuration of the stacking tray 60 may be modified as appropriate as long as it holds the bills such that when the stacking tray 60 projects from the housing, the front end of the bills are exposed to be picked out. Furthermore, the system for releasing the locking mechanism of the bill handling device may be configured such that the release is carried out for each bill handling device without involving an external management server or the like. That is, the collection process may be individually carried out for each bill handling device.

The bill handling device of the invention can be installed not only in between various game machines but also in various devices that handle bills, such as outside devices like various automatic vending machines.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A bill handling device comprising:

a housing;

a bill insertion slot provided on the front side of the housing, through which a bill can be inserted;

a bill container configured to store the bill inserted through the bill insertion slot;

an exit through which the bill container projects out of the housing;

an openable/closable shutter configured to close the exit, the shutter is configured to open the exit by a pivotal motion thereof into the housing;

a shutter drive module configured to open and close the shutter;

a lock member movably supported on the housing between a locked position where the shutter is not allowed to open and an unlocked position where the shutter is allowed to open; and a lock member moving module configured to move the lock member between the locked position and the unlocked position.

2. The bill handling device according to claim 1, further comprises:

a biasing module that always biases the lock member to the locked position.

3. The bill handling device according to claim 1, wherein the lock member has an opposite portion adjacent to and facing the shutter, on which portion are formed first recesses and projections along the moving direction of the lock member; and second recesses and projections engage the first recesses and projections, and are formed on a portion of the shutter that faces the opposite portion of the lock member; in the locked position, the first recesses and projections of the lock member and the second recesses and projections of the shutter are held such that they do not engage with each other, preventing the shutter from opening; and in the unlocked position, the first recesses and projections of the lock member and the second recesses and projections of the shutter engage with each other, allowing the shutter to be opened.

4. A bill handling device comprising:

a housing;

a bill insertion slot provided on the front side of the housing, through which a bill can be inserted;

an exit configured to allow a bill container to project out of the housing;

an openable/closable shutter configured to close the exit, the shutter is configured to open the exit by a pivotal motion thereof into the housing;

a shutter drive module configured to open and close the shutter;

a lock member movably supported on the housing between a locked position where the shutter is not allowed to open and an unlocked position where the shutter is allowed to open;

a lock member moving module configured to move the lock member between the locked position and the unlocked position; and a biasing module that always biases the lock member to the locked position.

5. The bill handling device according to claim 4, wherein the lock member has an opposite portion adjacent to and facing the shutter, on which portion are formed first recesses and projections along the moving direction of the lock member; and second recesses and projections engage the first recesses and projections, and are formed on a portion of the shutter that faces the opposite portion of the lock member; in the locked position, the first recesses and projections of the lock member and the second recesses and projections of the shutter are held such that they do not engage with each other, preventing the shutter from opening; and in the unlocked position, the first recesses and projections of the lock member and the second recesses and projections of the shutter engage with each other, allowing the shutter to be opened.

6. A bill handling device comprising:

a housing;

a bill insertion slot provided on the front side of the housing, through which a bill can be inserted;

a bill container for configured to store the bill inserted through the bill insertion slot;

an exit through which the bill container projects out of the housing;

an openable/closable shutter configured to close the exit, the shutter is configured to open the exit by a pivotal motion thereof into the housing;

a shutter drive module configured to open and close the shutter;

a lock member movably supported on the housing between a locked position where the shutter is not allowed to open and an unlocked position where the shutter is allowed to open;

a lock member moving module configured to move the lock member between the locked position and the unlocked position; and a biasing module that always biases the lock member to the locked position.

7. A bill handling device comprising:

a housing;

a bill insertion slot provided on the front side of the housing, through which a bill can be inserted;

a bill container configured to store the bill inserted through the bill insertion slot;

an exit through which the bill container projects out of the housing;

an openable/closable shutter configured to close the exit, the shutter is configured to open the exit by a pivotal motion thereof into the housing;

a shutter drive module for opening and closing the shutter;

a lock member movably supported on the housing between a locked position where the shutter is not allowed to open and an unlocked position where the shutter is allowed to open; and a lock member moving module configured to move the lock member between the locked position and the unlocked position, wherein the lock member has an opposite portion adjacent to and facing the shutter, on which portion are formed first recesses and projections along the moving direction of the lock member; and second recesses and projections engage the first recesses and projections, and are formed on a portion of the shutter that faces the opposite portion of the lock member;

in the locked position, the first recesses and projections of the lock member and the second recesses and projections of the shutter are held such that they do not engage with each other, preventing the shutter from opening; and in the unlocked position, the first recesses and projections of the lock member and the second recesses and projections of the shutter engage with each other, allowing the shutter to be opened.

* * * * *